United States Patent [19]

Hashimoto et al.

[11] Patent Number: 4,770,949

[45] Date of Patent: Sep. 13, 1988

[54] SURFACE ACTIVATED AMORPHOUS AND SUPERSATURATED SOLID SOLUTION ALLOYS FOR ELECTRODES IN THE ELECTROLYSIS OF SOLUTIONS AND THE METHOD FOR THEIR SURFACE ACTIVATION

[75] Inventors: Koji Hashimoto, Izumi; Naokazu Kumagai, Matsudo; Katsuhiko Asami; Asahi Kawashima, both of Sendai, all of Japan

[73] Assignees: Daiki Engineering Co., Ltd.; Koji Hashimoto, both of Tokyo, Japan

[21] Appl. No.: 892,827

[22] Filed: Aug. 4, 1986

[30] Foreign Application Priority Data

| | | | |
|---|---|---|---|
| Aug. 2, 1985 | [JP] | Japan | 60-169764 |
| Aug. 2, 1985 | [JP] | Japan | 60-169765 |
| Aug. 2, 1985 | [JP] | Japan | 60-169766 |
| Aug. 2, 1985 | [JP] | Japan | 60-169767 |

[51] Int. Cl.[4] ..... C22C 5/04

[52] U.S. Cl. ..... 428/687; 204/293; 148/403

[58] Field of Search ..... 148/403; 428/687; 204/292, 293; 420/425

[56] References Cited

U.S. PATENT DOCUMENTS

| | | | |
|---|---|---|---|
| 4,339,270 | 7/1982 | Hashimoto et al. | 204/293 |
| 4,560,454 | 12/1985 | Harris et al. | 204/293 |
| 4,609,442 | 9/1986 | Tenhover et al. | 204/293 |

FOREIGN PATENT DOCUMENTS

| | | | |
|---|---|---|---|
| 123111/85 | 12/1986 | Japan . | |
| 2146660 | 4/1985 | United Kingdom | 204/293 |

*Primary Examiner*—L. Dewayne Rutledge
*Assistant Examiner*—S. Kastler
*Attorney, Agent, or Firm*—Larson and Taylor

[57] ABSTRACT

Electrode materials and method for their surface activation are described. Alloys consisting of at least one element of the group consisting of Nb, Ta, Ti and Zr, at least one element of the group consisting of Ru, Rh, Pd, Ir and Pt, and balance being Ni are prepared by methods for preparation of amorphous alloys, and are amorphous or supersaturated solid solution. Their surfaces are activated to enhance electrocatalytic activity by enrichment of electrocatalytically active platinum group elements in the surface region in addition to surface roughening as a result of selective dissolution of Ni, Nb, Ta, Ti and Zr from the alloys during immersion in corrosive solutions. The surface-activated amorphous and supersaturated solid solution alloys possess high electrocatalytic activity and selectivity for a specific reaction as well as high corrosion resistance.

12 Claims, 10 Drawing Sheets

SURFACE ACTIVATED AMORPHOUS AND SUPERSATURATED SOLID SOLUTION ALLOYS FOR ELECTRODES IN THE ELECTROLYSIS OF SOLUTIONS AND THE METHOD FOR THEIR SURFACE ACTIVATION

FIELD OF THE INVENTION

The present invention relates to surface-activated amorphous and supersaturated solid solution alloys which are particularly suitable as electrode materials for the electrolysis of aqueous solutions such as sodium chloride solutions of various concentrations, temperatures and pH's, and to the method by which the amorphous and supersaturated solid solution alloys are surface-activated.

DESCRIPTION OF THE PRIOR ART

It is known in this field to use electrodes made of corrosion-resistant metals such as titanium-coated with noble metals. However, when such electrodes are used as anodes in the electrolysis of, for example, sea water, the noble metal coatings are corroded and sometimes peeled off from the titanium substrate. On the other hand, modern industries are using composite oxide electrodes consisting of corrosion-resistant metals as a substrate on which composite oxides such as platinum oxide and titanium oxide are coated. When these electrodes are used as the anode in the electrolysis of, for example, sea water, they have disadvantages that the composite oxides are sometimes peeled off from the metal substrate and that the energy efficiency is not high due to contamination of the chlorine gas with a large amount of oxygen.

In general, ordinary alloys are crystalline in the solid state. However, rapid quenching of some alloys with specific compositions from the liquid state gives rise to solidification to an amorphous structure. These alloys are called amorphous alloys. The amorphous alloys have significantly high mechanical strength in comparison with the conventional industrial alloys. Some amorphous alloys with the specific compositions have extremely high corrosion resistance that cannot be obtained in ordinary crystalline alloys. Even if the amorphous structure is not formed, the above-mentioned method for preparation of amorphous alloys is based on prevention of solid state diffusion of atoms during solidification, and hence the alloys thus prepared are solid solution alloys supersaturated with various solute elements and have various unique characteristics.

Two of the present inventors previously obtained a U.K. Patent GB 2051128 B entitled "Corrosion resistant amorphous noble metal-base alloys and electrodes made therefrom", possessing very high electrocatalytic activities for chlorine evolution and the high corrosion resistance in hot concentrated chloride solutions in addition to low activities for parasitic oxygen evolution. Furthermore, the present inventors applied the Japnese Patent Kokai No. 63336/85 entitled "Surface-activated amorphous alloys for electrodes in the electrolysis of solution". These alloys are composed mainly of platinum group metals and metalloids and are surface-activated by the method as described in the Japanese Patent Kokai No. 200565/82 by two of the present inventors. The surface-activated alloys possess superior electrocatalytic activity as the anode for the production of sodium hypochlorate by the electrolysis of unheated sodium chloride solutions whose NaCl concentrations are similar to that of sea water.

These inventions all provide electrode materials having superior characteristics. However, they are quite expensive because they consist mainly of platinum group metals.

Two of the present inventors and other coinventors applied the Japanese Patent Application No. 123111/85 which discloses:

(1) Amorphous alloy electrode materials which comprise 25 to 65 at % Ta, 0.3 to 45 at % one or more elements selected from the group consisting of Ru, Rh, Pd, Ir and Pt, and more than 30 at % Ni.

(2) Amorphous alloy electrode materials which comprise 25 to 65 at % in the total of 20 at % or more Ta and one or more elements selected from the group of Ti, Zr and Nb, 0.3 to 45 at % one or more elements selected from the group of Ru, Rh, Pd, Ir and Pt, and more than 30 at % Ni.

The above-mentioned alloys are suitable for the anode for oxygen production by electrolysis of acidic aqueous solutions because of high activity for oxygen evolution.

The present inventors further examined the electrocatalytic activity for chlorine evolution and found that, when a new method for surface activation is applied, the following alloys containing very small amounts of platinum group metals have very high electrocatalytic activities for chlorine evolution and low activities for parasitic oxygen evolution:

(1) Amorphous alloys consisting mainly of Ni and Nb.

(2) Amorphous alloys containing smaller amounts of Ta than those in the Japanese Patent Application No. 123111/85.

(3) Amorphous alloys formed by an addition of P to the amorphous alloys containing smaller amounts of platinum group elements among those in the Japanese Patent Application No. 123111/85.

(4) Supersaturated solid solution alloys that contain smaller amounts of Ta than those in the Japanese Patent Application No. 123111/85, and that are not totally amorphous. The present invention has been thus made.

SUMMARY OF THE INVENTION

The present invention aims to provide inexpensive, energy-saving and corrosion-resistant surface-activated amorphous and supersaturated solid solution alloys which possess sufficiently high corrosion resistance, high electrocatalytic activity for chlorine evolution and low activity for parasitic oxygen evolution, and to provide the method for the surface activation. The present invention is composed of the following 13 claims.

1. Surface activated amorphous alloys suitable for electrodes for electrolysis of solutions which comprise 25 to 65 at % Nb, and at least one element of 0.01 to 10 at % selected from the group consisting of Ru, Rh, Pd, Ir and Pt, with the balance being substantially Ni.

2. Surface activated amorphous alloys suitable for electrodes for electrolysis of solutions which comprise 25 to 65 at % in the total of 10 at % or more Nb and at % least one element selected from the group consisting of Ti, Zr and less than 20 at % Ta, and at least one element of 0.01 to 10 at % selected from the group consisting of Ru, Rh, Pd, Ir and Pt, with the balance being substantially Ni.

3. Surface activated amorphous alloys suitable for electrodes for electrolysis of solutions which comprise 25 to 65 at % Nb, at least one element of 0.01 to 10 at % selected from the group consisting of Ru, Rh, Pd, Ir and Pt, and less than 7 at P, with the balance being substantially 20 at or more Ni and then the above atomic percentages are based on the total composition of the alloy.

4. Surface activated amorphous alloys suitable for electrodes for electrolysis of solutions which comprise 25 to 65 at % in the total of 10 at % or more Nb and at least one element selected from the group consisting of Ti, Zr and less than 20 at % Ta, at least one element of 0.01 to 10 at % selected from the group consisting of Ru, Rh, Pd, Ir and Pt, and less than 7 at % P, with the balance being substantially 20 at % or more Ni and then the above atomic percentages are based on the total composition of the alloy.

5. Surface activated amorphous alloys suitable for electrodes for electrolysis of solutions which comprise 25 to 65 at % in the total of 5 to less than 20 at % Ta and at least one element selected from the group consisting of Ti, Zr and less than 10 at % Nb, and at least one element of 0.01 to 10 at % selected from the group consisting of Ru, Rh, Pd, Ir and Pt, with the balance being substantially Ni.

6. Surface activated amorphous alloys suitable for electrodes for electrolysis of solutions which comprise 25 to 65 at % in the total of 5 to less than 20 at % Ta and at least one element selected from the group consisting of Ti, Zr and less than 10 at % Nb, at least one element of 0.01 to 10 at % at least one element selected from the group consisting of Ru, Rh, Pd, Ir and Pt, and less than 7 at % P, with the balance being substantially 20 at % or more Ni, and then the above atomic percentages are based on the total composition of the alloy.

7. Surface activated amorphous alloys suitable for electrodes for electrolysis of solutions which comprise 25 to 65 at % Ta, at least one element of 0.01 to 10 at % selected from the group consisting of Ru, Rh, Pd, Ir and Pt, and less than 7 at % P, with the balance being substantially 20 at % or more Ni, and then the above atomic percentages are based on the total composition of the alloys.

8. Surface activated amorphous alloys suitable for electrodes for electrolysis of solutions which comprise 25 to 65 at % in the total of 20 at % or more Ta and at least one element selected from the group consisting of Ti, Zr and Nb, at least one element of 0.01 to 10 at % selected from the group consisting of Ru, Rh, Pd, Ir and Pt, and less than 7 at % P, with the balance being substantially 20 at % or more Ni, and then the above atomic percentages are based on the total composition of the alloys.

9. Surface activated supersaturated solid solution alloys suitable for electrodes for electrolysis of solutions which comprise 20 to less than 25 at % either or both Nb and Ta, and at least one element of 0.01 to 10 at % selected from the group consisting of Ru, Rh, Pd, Ir and Pt, with the balance being substantially Ni.

10. Surface activated supersaturated solid solution alloys suitable for electrodes for electrolysis of solutions which comprise 20 to less than 25 at % either or both Nb and Ta, at least one element of 0.01 to 10 at % selected from the group consisting of Ru, Rh, Pd, Ir and Pt, and less than 7 at % P, with the balance being substantially Ni.

11. Surface activated supersaturated solid solution alloys suitable for electrodes for electrolysis of solutions which comprise 20 to less than 25 at % in the total of either or both Ti and Zr and 5 at % or more of either or both Nb and Ta, and at least one element of 0.01 to 10 at % selected from the group consisting of Ru, Rh, Pd, Ir and Pt, with the balance being substantially Ni.

12. Surface activated supersaturated solid solution alloys suitable for electrodes for electrolysis of solutions which comprise 20 to less than 25 at % in the total of either or both Ti and Zr and 5 at % or more of either or both Nb and Ta, at least one element of 0.01 to 10 at % selected from the group consisting of Ru, Rh, Pd, Ir and Pt, and less than 7 at % P, with the balance being substantially Ni.

13. The method for surface activation of the above mentioned amorphous and supersaturated solid solution alloys suitable for electrodes for electrolysis of solutions, which is characterized by enrichment of electrocatalytically active platinum group elements in the surface region and by surface roughening as a result of selective dissolution of Ni, Nb, Ta, Ti and Zr from the alloys during immersion in corrosive solutions.

DESCRIPTION OF THE PREFERRED EMBODIMENTS

Figure 1:
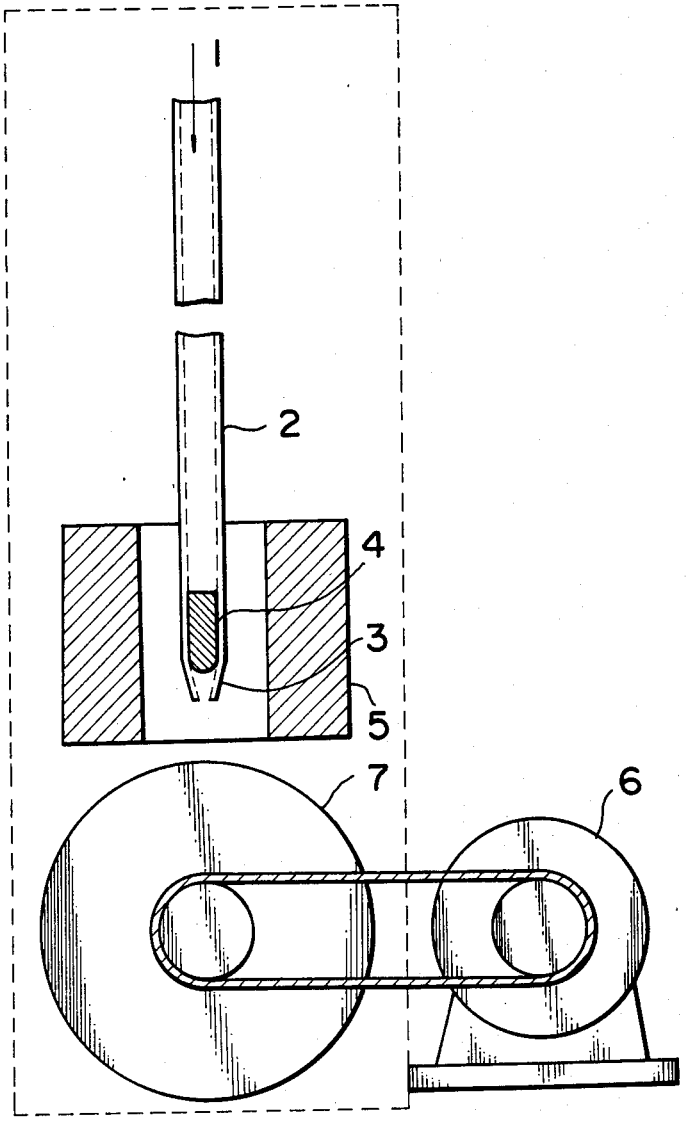
FIG. 1 shows an apparatus for preparing amorphous and supersaturated solid solution alloys of the present invention.

When the amorphous and supersaturated solid solution alloys are prepared by methods for preparation of amorphous alloys such as rapid quenching of molten alloys with compositions set forth in claims 1–12 and sputtter deposition by using targets of metal mixtures with average compositions set forth in claims 1–12 the above-mentioned alloy constituents are uniformly distributed in a single phase amorphous alloys or are supersaturated in supersaturated solid solution alloys.

The preparation of metal electrodes having the high electrocatalytic activity selective for a specific chemical reaction generally requires alloying with necessary amounts of beneficial elements. However, additions of large amounts of various elements to crystalline metals lead often to formation of multiple phases of different chemical properties and to poor mechanical strength. On the contrary, the amorphous alloys of the present invention are chemically homogeneous solid solution. Similarly, the supersaturated solid solution alloys of the present invention are prepared by the methods which present localization of constituents, and hence they are highly homogeneous. Consequently, the amorphous and supersaturated solid solution alloys possess high corrosion resistance and mechanical strength as well as stable and high electrocatalytic activity.

The components and compositions of the alloys of the present invention are specified as above for the following reasons:

In the alloys set forth in claims 1 to 8 Ni is a basic component which forms the amorphous structure when it coexists of at least one element selected from the group consisting of Nb, Ta, Ti and Zr. Therefore, in order to form the amorphous structure, the alloys set forth in claims 3, 4, 6, 7 and 8 should contain 20 at % or more Ni, and the alloys set forth in claims 1 to 8 should contain at least one element of 25 to 65 at % selected from the group consisting of Nb, Ta, Ti and Zr. In the alloys set forth in claims 9 to 12 Ni is a basic component necessary for the formation of alloys supersaturated with at least one element selected from the group consisting of Nb, Ta, Ti and Zr when these alloys are prepared by the methods used generally for the preparation of amorphous alloys. Nb, Ta, Ti and Zr are able to form stable passive films in very corrosive environments having a high oxidizing power to produce chlorine. For the supersaturated solid solution alloys in claims 9 to 12 to exhibit sufficiently high corrosion resistance, the content of at least one element selected from the group consisting of Nb, Ta, Ti and Zr should be 20 at % or more. Among Nb, Ta, Ti and Zr, Ta is most effective in enhancing the passivating ability and corrosion resistance, and Nb is the second best element. The effects of Ti and Zr on the corrosion resistance are inferior to Ta and Nb, and hence Nb and Ta should not be entirely replaced by Ti and Zr in the alloys of the present invention. For the amorphous alloys in claims 5 and 6 to possess the sufficiently high corrosion resistance, the Ta content should be 5 at % or more. Similarly the alloys set forth in claims 2 and 4 should contain 10 at % or more Nb so that the alloys show the sufficiently high corrosion resistance. The content of either or both Ta and Nb in the supersaturated solid solution alloys in claims 11 and 12 should be 5 at % or more for their sufficient corrosion resistance.

The platinum group elements Ru, Rh, Pd, Ir and Pt are all effective for the high electrocatalytic activity, and hence the electrocatalytic activity requires at least one of these platinum group elements should be 0.01 at % or more. However, the addition of large amounts of these platinum group elements is sometimes detrimental for the high corrosion resistance. As will be mentioned later, since the surface activation treatment is applied to the alloys of the present invention, the addition of more than 10 at % of at least one element selected from Ru, Rh, Pd, Ir and Pt is not necessary.

P enhances the formation of passive films of Nb, Ta, Ti and Zr in highly oxidizing environments for the production of chlorine, and facilitates the formation of the amorphous structure, but a large amount of P addition is not necessary for the purpose of the present invention. Thus the P content of the alloys in claims 3, 4, 6, 7, 8, 10 and 12 does not exceed 7 at %.

The purpose of the present invention can be also attained by addition of other elements such as 3 at % or less Mo and/or V, 20 at % or less Hf and/or Cr and 10 at % or less Fe and/or Co. Metalloids B, Si and C are generally known to enhance the formation of amorphous structure. It cannot be said that these metalloids are effective since the addition of large amounts of these elements sometimes decreases the stability of the passive films in the highly oxidizing environments. However, the addition of these metalloids up to 7 at % is not detrimental for the corrosion resistance and is effective in enhancing the glass forming ability.

Tables 1–4 show the components and compositions of the alloys set forth in claims 1 to 12.

On the other hand, it is necessary to enhance the electrocatalytic activity for the electrodes for electrolysis by the surface activation treatment which leads to accumulation of electrocatalytically active platinum group elements in the electrode surfaces as well as increasing the electrochemically effective surface area. The surface activation treatment is carried out by immersion of the amorphous and supersaturated solid solution alloys into hydrofluoric acids. The concentration and temperature of the hydrofluoric acids are chosen depending on the alloy composition, and commercial 46 % HF can also be used for this purpose. When the amorphous and supersaturated solid solution alloys are immersed in the hydrofluoric acids, hydrogen evolution takes place violently on the platinum group elements which distribute uniformly in homogeneous single phase amorphous alloys and in supersaturated solid solution alloys of high homogeneity. Because of violent hydrogen evolution the immersion of these alloys in hydrofluoric acids results in selective dissolution of Ni, Nb, Ta, Ti and Zr which are less noble than the platinum group elements. Their selective dissolution occurs quite uniformly from the alloy surfaces because of the high homogeneity of the alloys, and leads to black coloration by surface roughening and to enrichment of platinum group elements in the surfaces. Therefore, the surface activation treatment is ceased when the surfaces turn black.

On the other hand, when the surface activation treatment is applied to conventionally processed crystalline alloys whose average compositions are similar to those of the alloys of the present invention, the surface activation treatment is not useful because selective dissolution of Ni, Nb, Ta, Ti and Zr hardly occurs from the conventionally processed crystalline heterogeneous alloys consisting of multiple phases in which platinum group elements, Ni, Nb, Ta, Ti and Zr are heterogeneously localized. Furthermore, when the crystalline alloys are used as the anode they are easily corroded because of alloy heterogeneity.

On the contrary, the alloy constituents distribute uniformly in the amorphous and supersaturated solid solution alloys of the present invention. Accordingly, the immersion of these alloys in hydrofluoric acids leads to selective and uniform dissolution of Ni, Nb, Ta, Ti and Zr from the alloy surfaces with the consequent enlargement of effective surface area along with remarkable enrichment of the platinum group elements in the surfaces, and hence leads to activation of the entire surfaces of the alloys.

Consequently, the amorphous and supersaturated solid solution alloys of the present invention possess superior characteristics as electrodes for electrolysis of solutions along with the corrosion resistance.

The preparation of the amorphous and supersaturated solid solution alloys of the present invention can be carried out by any kinds of methods for preparation of amorphous alloys, such as rapid quenching from the liquid state, various methods for formation of amorphous alloys through the vapor phase, and destruction of the long range ordered structure of solid surfaces with a simultaneous addition of alloying elements by ion implantation.

One embodiment of apparatus for preparing the amorphous and supersaturated solid solution alloys of the present invention is shown in FIG. 1. This is called the rotating wheel method. The apparatus is placed in a vacuum chamber indicated by a dotted rectangle. In the Figure, a quartz tube (2) has a nozzle (3) at its lower end in the vertical direction, and raw materials (4) and an inert gas for preventing oxidation of the raw materials are fed from the inlet (1). A heater (5) is placed around the quartz tube (2) so as to heat the raw materials (4). A high speed wheel (7) is placed below the nozzle (3) and is rotated by a motor (6).

For the preparation of the amorphous and supersaturated solid solution alloys the vacuum chamber is evacuated up to about $10^{-5}$ torr. After the evacuated vacuum chamber is filled with argon gas of about 1 atm, the raw materials (4) of the prescribed compositions are melted by the heater (5). The molten alloy impinges under the pressure of the inert gas onto the outer surface of the wheel (7) which is rotated at a speed of 1,000 to 10,000 rpm whereby an amorphous or supersaturated solid solution alloy is formed as a long thin plate, which may for example have a thickness of 0.05 mm, a width of 5 mm and a length of several meters.

The amorphous alloys of the present invention produced by the above-mentioned procedures generally have excellent mechanical properties typical of rapidly solidified alloys, particularly as regards the possibility of complete bending and cold rolling to a degree greater than 50% reduction in thickness.

The amorphous and supersaturated solid solution alloys of the present invention will be further illustrated by certain examples which are provided only for purpose of illustration and are not intended to be limiting the present invention.

TABLE 1

| Claim No. | Nb | Ti, Zr, Ta (*1) | Ru, Rh, Pd Ir, Pt (*2) | (atomic %) P | Ni (*3) |
|---|---|---|---|---|---|
| 1 | 25–65 | | 0.01–10 | | Balance |
| 2 | 10 or more | 25–65 with Nb | 0.01–10 | | Balance |
| 3 | 25–65 | | 0.01–10 | 7 or less | Balance (20 or more) |
| 4 | 10 or more | 25–65 with Nb | 0.01–10 | 7 or less | Balance (20 or more) |

(*1) at least one element of Ti, Zr and Ta
(*2) at least one element of Ru, Rh, Pd, Ir and Pt
(*3) substantially Ni

TABLE 2

| Claim No. | Ta | Ti, Zr, Nb (*4) | Ru, Rh, Pd Ir, Pt (*2) | (atomic %) P | Ni (*3) |
|---|---|---|---|---|---|
| 5 | 5 or more and less than 20 | 25–65 with Ta | 0.01–10 | | Balance |
| 6 | 5 or more and less than 20 | 25–65 with Ta | 0.01–10 | 7 or less | Balance (20 or more) |

(*2) at least one element of Ru, Rh, Pd, Ir and Pt
(*3) substantially Ni
(*4) at least one element of Ti, Zr and less than 10 at % Nb

TABLE 3

| Claim No. | Ta | Ti, Zr, Nb (*5) | Ru, Rh, Pd Ir, Pt (*2) | (atomic %) P | Ni (*3) |
|---|---|---|---|---|---|
| 7 | 28–65 | | 0.01–10 | 7 or less | Balance (20 or more) |
| 8 | 20 or more | 25–65 with Ta | 0.01–10 | 7 or less | Balance (20 or more) |

(*2) at least one element of Ru, Rh, Pd, Ir and Pt
(*3) substantially Ni
(*5) at least one element of Ti, Zr and Nb

TABLE 4

| Claim No. | Nb, Ta (*6) | Ti, Zr (*7) | Ru, Rh, Pd Ir, Pt (*2) | (atomic %) P | Ni (*3) |
|---|---|---|---|---|---|
| 9 | 20 or more and less than 25 | | 0.01–10 | | Balance |
| 10 | 20 or more and less than 25 | | 0.01–10 | 7 or less | Balance |
| 11 | 5 or more | 20 or more and less than 25 with Nb and Ta | 0.01–10 | | Balance |
| 12 | 5 or more | 20 or more and less than 25 with Nb and Ta | 0.01–10 | 7 or less | Balance |

(*2) at least one element of Ru, Rh, Pd, Ir and Pt
(*3) substantially Ni
(*6) either or both Nb and Ta
(*7) either or both Nb and Zr

EXAMPLE 1

Figure 2:
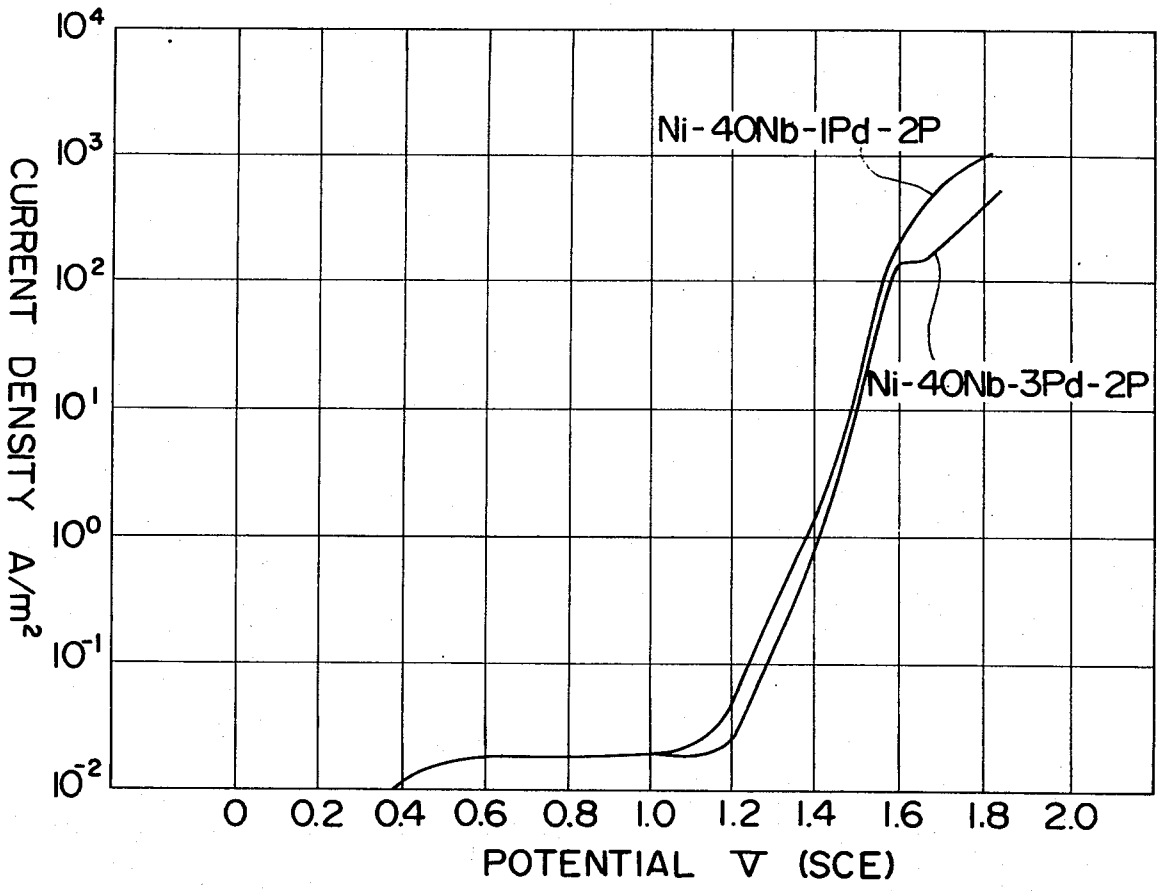
FIG. 2 shows anodic polarization curves of amorphous Ni-40Nb-1Pd-2P and Ni-40Nb-3Pd-2P alloys of the present invention measured in a 0.5 M NaCl solution at 30° C.

Raw alloys were prepared by induction melting of mixtures of commercial metals and home-made nickel phosphide under an argon atmosphere. After remelting of the raw alloys under an argon atmosphere amorphous alloys were prepared by the rotating wheel method by using the apparatus shown in FIG. 1. The amorphous alloys thus prepared were 0.01–0.05 mm thick, 1–5 mm wide and 3–20 mm long ribbons, whose nominal compositions are shown in Table 5. The formation of amorphous structure was confirmed by X-ray diffraction. Surfaces of these alloys were polished mechanically with SiC paper up to #1000 in cyclohexane. The confirmation of high corrosion resistance of these alloys were carried out by measurements of anodic polarization curves in a 0.5 M NaCl solution at 30° C. FIG. 2 shows examples of polarization curves measured. Polarization curves of amorphous Ni-Nb alloys are all quite similar to those shown in FIG. 2 and are not distinguishable from each other. These alloys are all spontaneously passive. Anodic polarization of these alloys leads to appearance of very low passive current densities less than $2\times10^{-2}$ $Am^{-2}$ up to about 1.1 V (SCE). A further increase in potential results in sharp current increase at about 1.2 V (SCE) due to evolutions of chlorine and oxygen.

Figure 3:
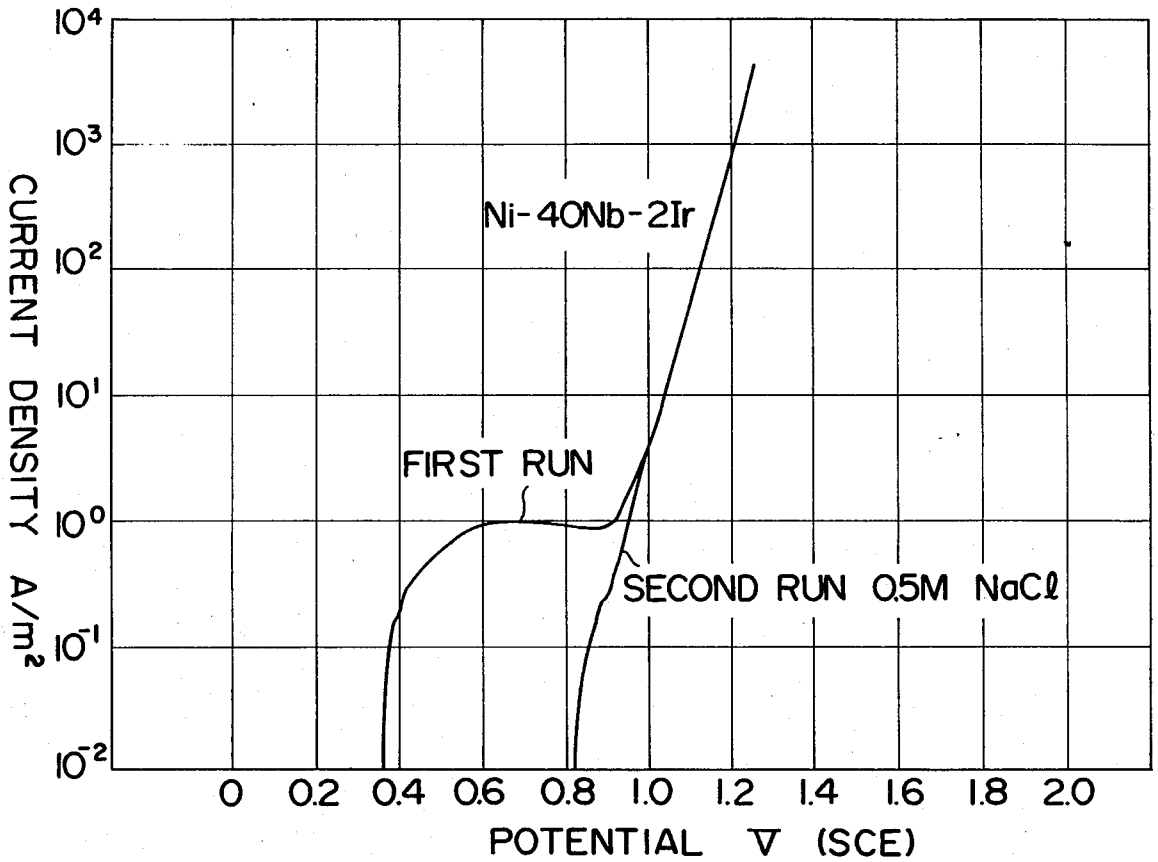
FIG. 3 shows anodic polarization curves of surface-activated amorphous Ni-40Nb-2Ir alloy of the present invention measured repeatedly twice in a 0.5 M NaCl solution at 30° C.

The surface activation treatment of these alloys was carried out by immersion in 46% HF at ambient temperature for several minutes to several tens of minutes until the alloy surfaces turned black. Subsequently their anodic polarization curves were measured in the 0.5 M NaCl solution at 30° C. FIG. 3 shows examples of polarization curves measured repeatedly twice. The polarization curves of the amorphous alloys of the present invention after the surface activation treatment were all almost the same as those shown in FIG. 3 and were undistinguishable from each other. The first polarization curve measured after the surface activation treatment exhibited the anodic current density of the order of $10^0$ $Am^{-2}$ at about 0.4–0.8 V (SCE). This is due to dissolution of alloy constituents remaining without complete dissolution during the surface activation treatment in 46% HF. However, after the alloys were polarized at further higher potentials, the open circuit potential became very high and the second measurement of the polarization curve showed no longer active dissolution current in the potential region of 0.4–0.8 V (SCE). This indicates that, once the surface-activated alloys were polarized in the high potential region for chlorine evolution with a consequent dissolution of soluble constituents, the subsequent polarization does not result in alloy dissolution but evolves chlorine. The anodic current density for chlorine evolution at potentials higher than 1.0 V (SCE) are not different between the first and second measurements. For instance the current density at about 1.2 V (SCE) was increased about 4 orders of magnitude by the surface activation treatment.

In order to examine the corrosion resistance of the surface-activated alloys during chlorine evolution, the following procedures were made: Polarization in the 0.5 M NaCl solution of 30° C. at 1.25 V (SCE) for 12 hrs.; rinsing with distilled water and acetone; drying in a desiccator for 12 hrs.; weight measurements of the alloy specimens by a microbalance; polarization in the 0.5 M NaCl solution of 30° C. at 1.25 V (SCE) for 24 hrs.; rinsing with distilled water and acetone; drying in a desiccator for 12 hrs.: and weight measurements by the microbalance. By these procedures the measurements of the steady state weight losses of the alloy specimens during acting as the anode for the chlorine evolution for 24 hrs. were attempted. When these procedures were applied to specimens No. 3, 13, 18, 21, 24 and 32 which are representative of the amorphous alloys of the present invention, no weight changes of the specimens used as the anode for electrolysis of the 0.5 M NaCl solution for 24 hrs. were detected. This reveals that they are immune to corrosion when used as the anode for chlorine evolution in the 0.5 M NaCl solution.

The current efficiencies of some alloys representative of the amorphous alloys of the present invention were measured by quantitative iodometric determination of chlorine evolved during electrolysis of the 0.5 M NaCl solution until 1000 coulomb/l. The current efficiencies are given in Table 6. The current efficiencies of the amorphous alloys of the present invention for chlorine evolution are similar to or higher than the current efficiency of the Pt-Ir/Ti electrode which is known to have the highest activity among currently used electrodes for the electrolysis of dilute NaCl solutions such as sea water.

The amorphous alloys of the present invention are all inexpensive because of low contents of platinum group metals.

TABLE 5

Nominal Compositions of Alloys in Example 1 (at %)

| Specimen No. | Ni | Nb | Ta | Ti | Zr | Ru | Rh | Pd | Ir | Pt | P |
|---|---|---|---|---|---|---|---|---|---|---|---|
| 1 | 48 | 50 | | | | 2 | | | | | |
| 2 | 34.5 | 65 | | | | | 0.5 | | | | |
| 3 | 59 | 40 | | | | | 1 | | | | |
| 4 | 58 | 40 | | | | | 2 | | | | |
| 5 | 57 | 40 | | | | | 3 | | | | |
| 6 | 55 | 40 | | | | | 5 | | | | |
| 7 | 63 | 30 | | | | | 7 | | | | |
| 8 | 65 | 25 | | | | | 10 | | | | |
| 9 | 59.95 | 40 | | | | | | 0.05 | | | |
| 10 | 59.9 | 40 | | | | | | 0.1 | | | |
| 11 | 59.7 | 40 | | | | | | 0.3 | | | |
| 12 | 59.5 | 40 | | | | | | 0.5 | | | |
| 13 | 59 | 40 | | | | | | 1 | | | |
| 14 | 57.9 | 40 | | | | | | 0.1 | | | 2 |
| 15 | 57.5 | 40 | | | | | | 0.5 | | | 2 |
| 16 | 57 | 40 | | | | | | 1 | | | 2 |
| 17 | 55 | 40 | | | | | | 3 | | | 2 |
| 18 | 58.5 | 40 | | | | | | 1 | 0.5 | | |
| 19 | 58 | 40 | | | | | | 1 | 1 | | |
| 20 | 59.98 | 40 | | | | | | | 0.02 | | |
| 21 | 59.95 | 40 | | | | | | | 0.05 | | |
| 22 | 59.1 | 40 | | | | | | | 0.1 | | |
| 23 | 59.7 | 40 | | | | | | | 0.3 | | |
| 24 | 59.5 | 40 | | | | | | | 0.5 | | |
| 25 | 59 | 40 | | | | | | | 1 | | |
| 26 | 58 | 40 | | | | | | | 2 | | |
| 27 | 48 | 50 | | | | | | | 2 | | |
| 28 | 53.99 | 40 | | | | | | | 0.01 | | 6 |
| 29 | 60 | 30 | | | | | | | 10 | | |
| 30 | 59 | 40 | | | | | | | | 1 | |
| 31 | 57 | 40 | | | | | | | | 3 | |
| 32 | 64.5 | 10 | 19 | 6 | | | | 0.5 | | | |
| 33 | 64.5 | 20 | | | 15 | | | | 0.5 | | |
| 34 | 63.5 | 20 | 5 | | 10 | 1 | | 0.5 | | | |

TABLE 6

Current Efficiencies of Alloys for Chlorine Evolution in 0.5 M NaCl at 30° C. (%)

| Specimen No. | Current Density A $m^{-2}$ 500 | 1000 | 2000 | 3000 | 4000 | 5000 |
|---|---|---|---|---|---|---|
| 1 | | | 69.8 | | | |
| 2 | | | 69.5 | | | |
| 3 | 60.3 | 68.6 | 70.0 | 68.8 | 69.4 | 68.2 |
| 7 | | | 69.9 | | | |
| 9 | | | 92.1 | | | |
| 12 | | | 93.5 | | | |
| 16 | 70.6 | 83.8 | 92.3 | 94.4 | 95.3 | 94.1 |
| 18 | 76.0 | 87.5 | 92.9 | 94.1 | 93.5 | 90.5 |
| 20 | | | 86.0 | | | |
| 21 | | | 87.1 | | | |
| 24 | 65.1 | 77.2 | 86.9 | 85.0 | 84.4 | 84.4 |
| 28 | 60.3 | 74.0 | 87.2 | 88.7 | | |
| 30 | | | 90.1 | | | |
| 32 | | | 93.7 | | | |
| 34 | | | 95.5 | | | |
| Currently used Pt—Ir/Ti Electrode For Comparison | 57.8 | 75.3 | 76.4 | | | |

EXAMPLE 2

Figure 4:
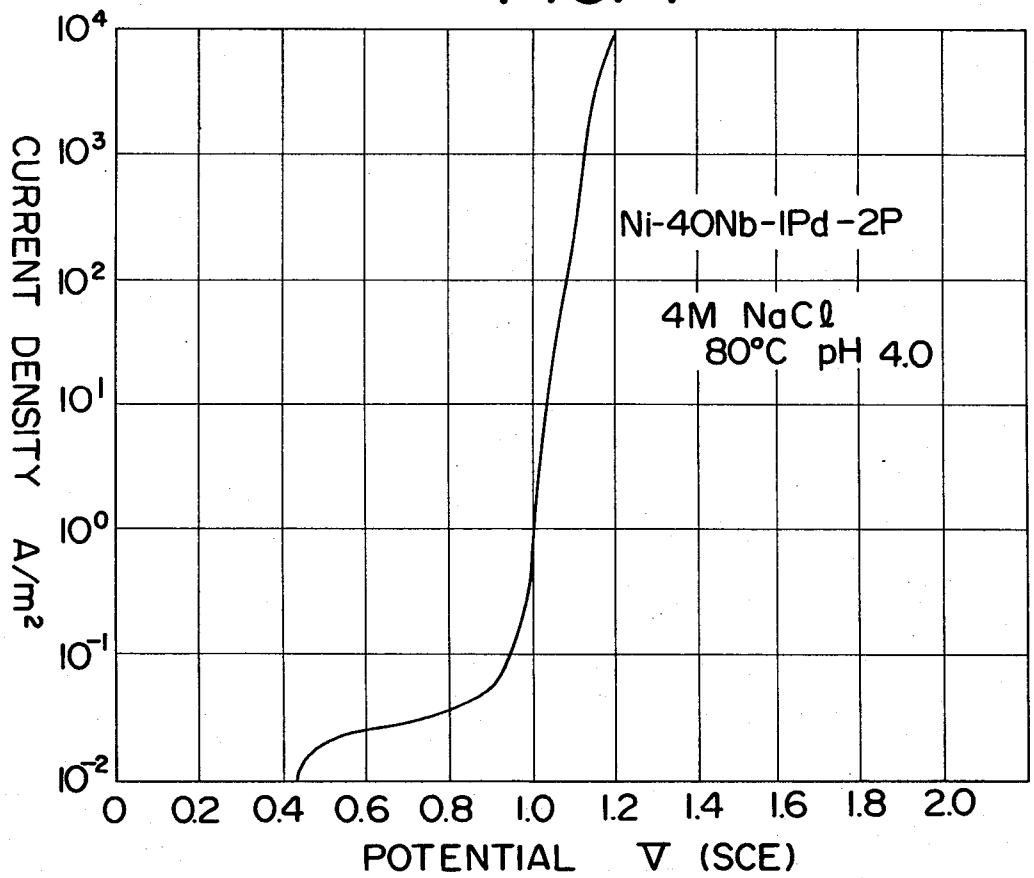
FIG. 4 shows anodic polarization curve of surface-activated amorphous Ni-40Nb-1Pd-2P alloy of the present invention measured in a 4 M NaCl solution of pH 4 and 80° C.

The alloys which were prepared and surface-activated similarly to Example 1 are used as the anode for electrolysis of a 4 M NaCl solutions at 80° C. and pH 4 which is similar to the electrolyte for chlorine production in chlor-alkali industry. An example of the polarization curve is given in FIG. 4 and indicates that the inexpensive electrode materials of the present invention possess the very high electrocatalytic activity.

EXAMPLE 3

Figure 5:
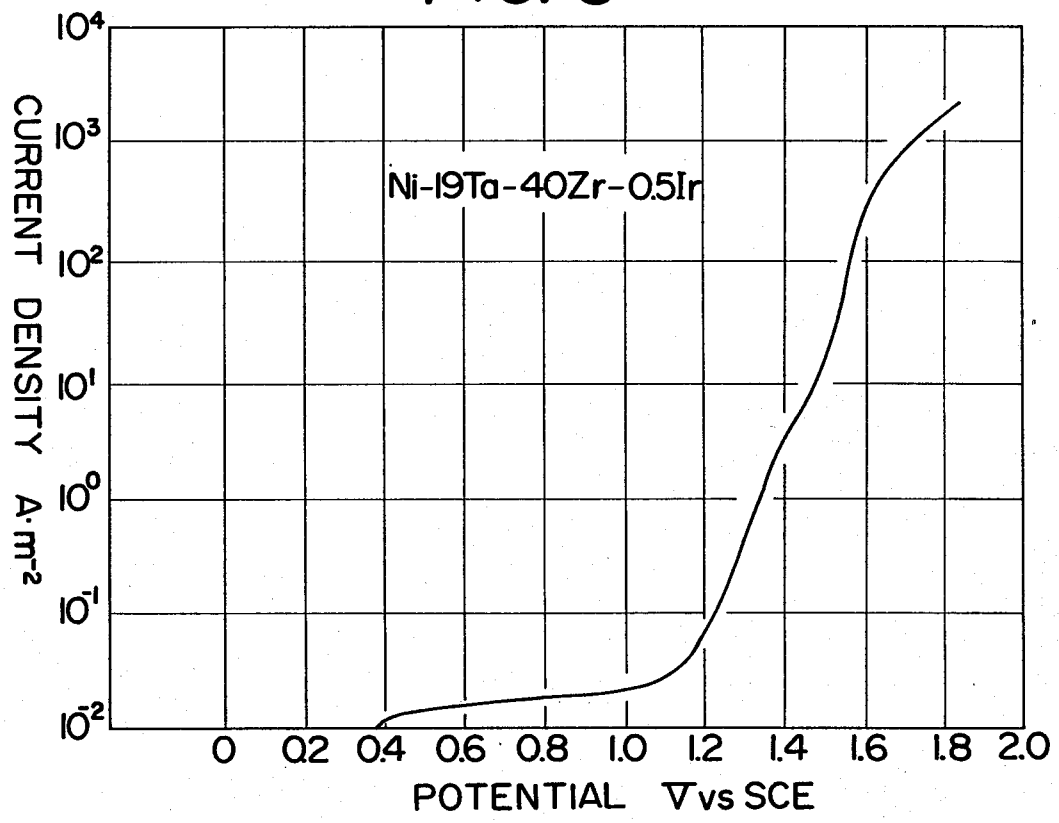
FIG. 5 shows anodic polarization curve of amorphous Ni-19Ta-40Zr-0.5Ir alloy of the present invention measured in a 0.5 M NaCl solution at 30° C.

The amorphous alloys were prepared similarly to Example 1. Their nominal compositions are given in Table 7. The formation of the amorphous structure was confirmed by X-ray diffraction. Surfaces of these alloys were polished mechanically with SiC paper up to #1000 in cyclohexane. The confirmation of high corrosion resistance of these alloys were carried out by measurements of anodic polarization curves in a 0.5 M NaCl solution at 30° C. FIG. 5 shows an example of polarization curve measured. Polarization curves of the amorphous alloys are all quite similar to that shown in FIG. 5 and are not distinguishable from each other. These alloys are all spontaneously passive. Anodic polarization of these alloys leads to appearance of very low passive current densities less than $2\times10^{-2}$ $Am^{-2}$ up to about 1.1 V (SCE). A further increase in potential results in sharp current increase at about 1.2 V (SCE) due to evolutions of chlorine and oxygen.

Figure 6:
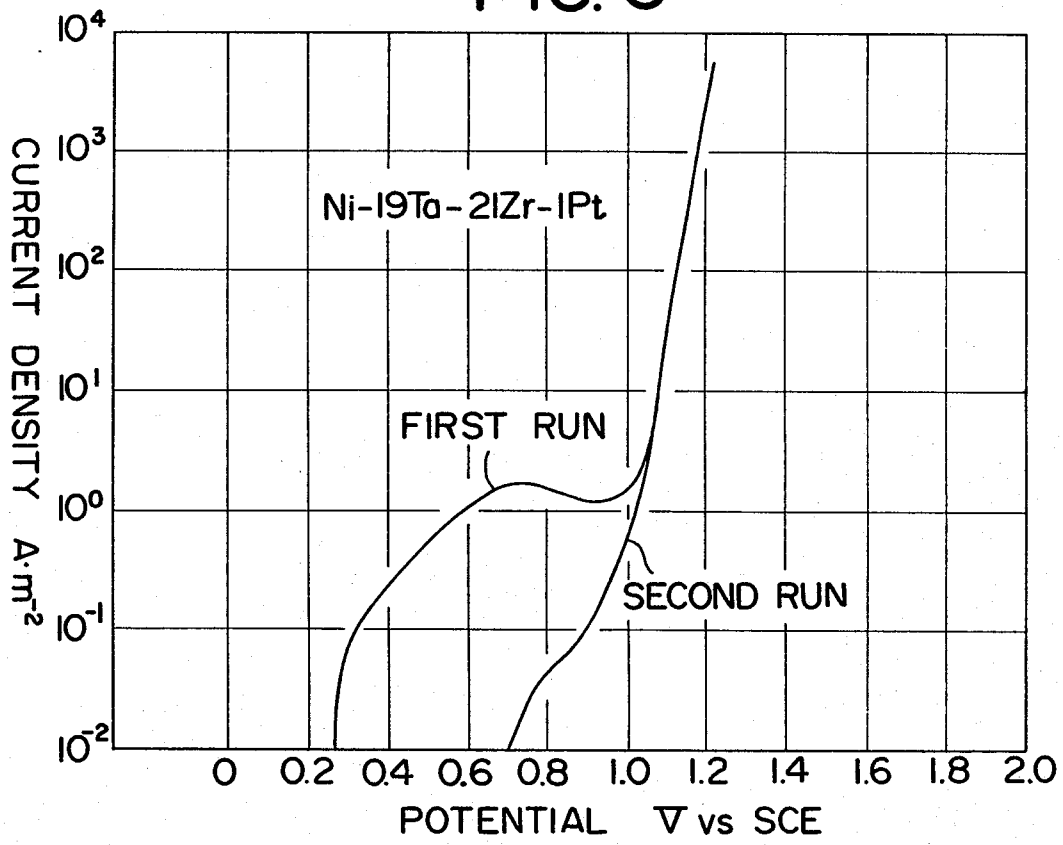
FIG. 6 shows anodic polarization curves of surface-activated amorphous Ni-19Ta-21Zr-1Pt alloy of the present invention measured repeatedly twice in a 0.5 M NaCl solution at 30° C.

The surface activation treatment of these alloys was carried out by immersion in 46% HF at ambient temperature for several minutes to several tens of minutes until the alloy surfaces turned black. Subsequently their anodic polarization curves were measured in the 0.5 M NaCl solution at 30° C. FIG. 6 shows examples of polarization curves measured repeatedly twice. The polarization curves of the amorphous alloys of the present invention after the surface activation treatment were all almost the same as those shown in FIG. 6 and were undistinguishable from each other. The first polarization curve measured after the surface activation treatment exhibited the anodic current density of the order of $10^0$ $Am^{-2}$ at about 0.4–0.8 V (SCE). This is due to dissolution of alloy constituents remaining without complete dissolution during the surface activation treatment in 46% HF. However, after the alloys were polarized at further higher potentials, the open circuit potential became very high and the second measurement of the polarization curve showed no longer active dissolution current in the potential region of 0.4–0.8 V (SCE). This indicates that, once the surface-activated alloys were polarized in the high potential region for chlorine evolution with a consequent dissolution of soluble constituents, the subsequent polarization does not result in alloy dissolution but evolves chlorine. The anodic current density for chlorine evolution at potentials higher than 1.0 V (SCE) are not different between the first and second measurements. For instance the current density at about 1.2 V (SCE) was increased about 4 orders of magnitude by the surface activation treatment.

In order to examine the corrosion resistance of the surface-activated alloys during chlorine evolution, the following procedures were made: Polarization in the 0.5 M NaCl solution of 30° C. at 1.25 V (SCE) for 12 hrs.; rinsing with distilled water and acetone; drying in a desiccator for 12 hrs.; weight measurements of the alloy specimens by a microbalance; polarization in the 0.5 M NaCl solution of 30° C. at 1.25 V (SCE) for 24 hrs.; rinsing with distilled water and acetone; drying in a desiccator for 12 hrs.; and weight measurements by the microbalance. By these procedures the measurements of the steady state weight losses of the alloy specimens during acting as the anode for the chlorine evolution for 24 hrs. were attempted. When these procedures were applied to specimens No. 37, 38, 41, 46, 63 and 67 which are representative of the amorphous alloys of the present invention, no weight changes of the specimens used as the anode for electrolysis of the 0.5 M NaCl solution for 24 hrs were detected. This reveals that they are immune to corrosion when used as the anode for chlorine evolution in the 0.5 M NaCl solution.

The current efficiencies of some alloys representative of the amorphous alloys of the present invention were measured by quantitative iodometric determination of chlorine evolved during electrolysis of the 0.5 M NaCl solution until 1000 coulomb/l. The current efficiencies are given in Table 8. The current efficiencies of the amorphous alloys of the present invention for chlorine evolution are similar to or higher than the current efficiency of the Pt-Ir/Ti electrode which is known to have the highest activity among currently used electrodes for the electrolysis of dilute NaCl solutions such as sea water.

The amorphous alloys of the present invention are all inexpensive because of low contents of platinum group metals.

TABLE 7

Nominal Compositions of Alloys in Example 3 (at %)

| Specimen No. | Ni | Ta | Ti | Zr | Nb | Ru | Rh | Pd | Ir | Pt | P |
|---|---|---|---|---|---|---|---|---|---|---|---|
| 35 | 59 | 5 | 35 | | | 1 | | | | | |
| 36 | 53 | 10 | | 35 | | 2 | | | | | |
| 37 | 54 | 15 | | 30 | | | 1 | | | | |
| 38 | 49 | 19 | | 30 | | | 2 | | | | |
| 39 | 30.5 | 19 | | 46 | | | 3 | 0.5 | | | 1 |
| 40 | 65 | 19 | 6 | | | | 10 | | | | |
| 41 | 69.98 | 19 | 11 | | | | | 0.02 | | | |
| 42 | 69.95 | 19 | 11 | | | | | 0.05 | | | |
| 43 | 69.9 | 19 | | 11 | | | | 0.1 | | | |
| 44 | 69.5 | 19 | | 11 | | | | 0.5 | | | |
| 45 | 69 | 19 | 11 | | | | | 1 | | | |
| 46 | 62 | 19 | 16 | | | | | 1 | | | 2 |
| 47 | 55 | 19 | 16 | | | | | 5 | | | 5 |
| 48 | 49 | 19 | 16 | | | | | 9 | | | 7 |
| 49 | 64.98 | 19 | | 16 | | | | | 0.02 | | |
| 50 | 69.95 | 19 | | 11 | | | | | 0.05 | | |
| 51 | 59.9 | 19 | | 21 | | | | | 0.1 | | |
| 52 | 54.8 | 19 | | 26 | | | | | 0.2 | | |
| 53 | 40.5 | 19 | | 40 | | | | | 0.5 | | |
| 54 | 64 | 19 | | 16 | | | | | 1 | | |
| 55 | 55 | 19 | 21 | | | | | | 5 | | |
| 56 | 57.5 | 19 | | 21 | | | | | 0.5 | | 2 |
| 57 | 59 | 19 | | 21 | | | | | | 1 | |
| 58 | 57 | 19 | 21 | | | | | | | 3 | |
| 59 | 54 | 19 | 16 | 10 | | 0.5 | | 0.5 | | | |
| 60 | 53.5 | 19 | 11 | 15 | | | | 1 | 0.5 | | |
| 61 | 52 | 19 | 11 | 15 | | | | 1 | | | 2 |
| 62 | 46 | 5 | 40 | 5 | | | | 1 | | | 2 |
| 63 | 70 | 19 | | | 9 | | 1 | 1 | | | |
| 64 | 63 | 5 | 20 | | 9 | | | 1 | 2 | | |
| 65 | 60 | 5 | | 20 | 9 | | | | 1 | 5 | |
| 66 | 62 | 5 | 10 | 10 | 9 | 1 | 2 | 1 | | | |
| 67 | 53 | 15 | 15 | 6 | 4 | | 2 | 1 | 1 | | 3 |

TABLE 8

Current Efficiencies of Alloys For Clorine Evolution

| Specimen No. | Current Efficiency at 2000 $Am^{-2}$ (%) |
|---|---|
| 35 | 69.7 |
| 36 | 69.9 |
| 37 | 70.1 |
| 38 | 70.0 |
| 39 | 92.0 |
| 41 | 92.4 |
| 44 | 93.0 |
| 46 | 92.8 |
| 49 | 86.8 |
| 51 | 87.2 |
| 53 | 86.5 |
| 54 | 86.9 |
| 56 | 87.3 |
| 57 | 92.3 |

TABLE 8-continued

| Current Efficiencies of Alloys For Clorine Evolution | |
|---|---|
| Specimen No. | Current Efficiency at 2000 $Am^{-2}$ (%) |
| 59 | 93.3 |
| 60 | 93.1 |
| 61 | 93.5 |
| 63 | 93.0 |
| 66 | 91.5 |
| Currently used Pt—Ir/Ti Electrode for Comparison | 76.4 |

EXAMPLE 4

Figure 7:
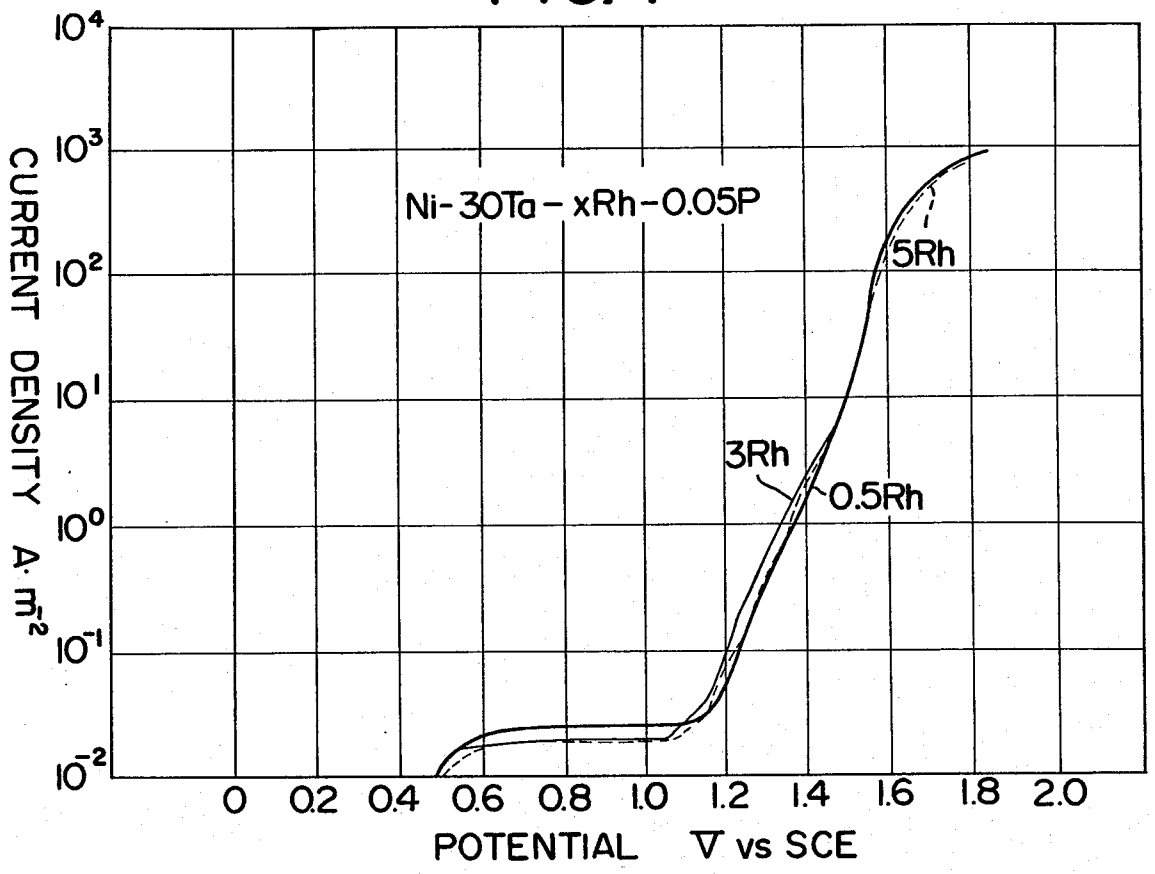
FIG. 7 shows anodic polarization curves of amorphous Ni-30Ta-xRh-0.05P alloys of the present invention measured in a 0.5 M NaCl solution at 30° C.

The amorphous alloys were prepared similarly to Example 1. Their nominal compositions are given in Table 9. The formation of the amorphous structrure was confirmed by X-ray diffraction. Surfaces of these alloys were polished mechanically with SiC paper up to #1000 in cyclohexane. The confirmation of high corrosion resistance of these alloys were carried out by measurements of anodic polarization curves in a 0.5 M NaCl solution at 30° C. FIG. 7 shows examples of polarization curves measured. Polarization curves of the amorphous alloys are all quite similar to those shown in FIG. 7 and are not distinguishable from each other. These alloys are all spontaneously passive. Anodic polarization of these alloys leads to appearance of very low passive current densities less than $3\times10^{-2}$ $Am^{-2}$ up to about 1.1 V (SCE). A further increase in potential results in sharp current increase at about 1.2 V (SCE) due to evolutions of chlorine and oxygen.

Figure 8:
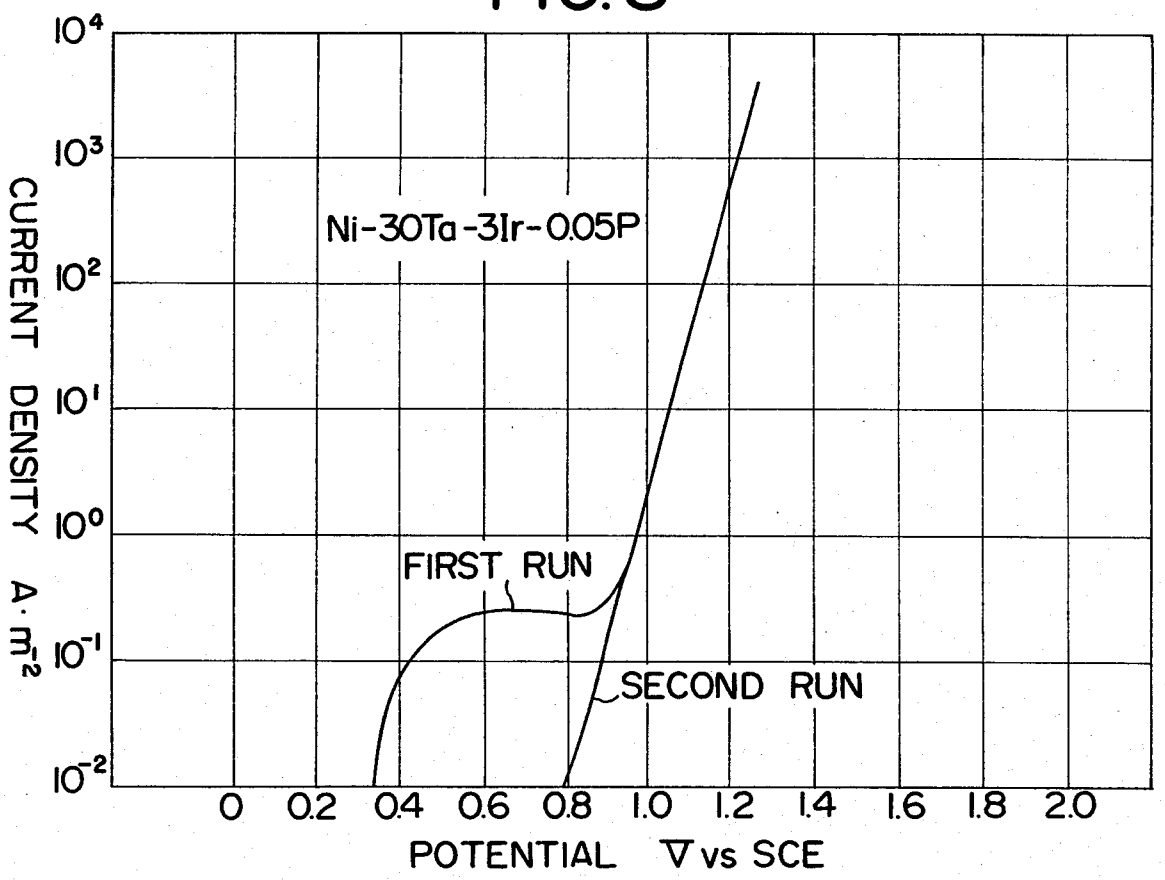
FIG. 8 shows anodic polarization curves of surface-activated amorphous Ni-30Ta-3Ir-0.05P alloy of the present invention measured repeatedly twice in a 0.5 M NaCl solution at 30° C.

The surface activation treatment of these alloys was carried out by immersion in 46% HF at ambient temperature for several minutes to several tens of minutes until the alloy surfaces turned black. Subsequently their anodic polarization curves were measured in the 0.5 M NaCl solution at 30° C. FIG. 8 shows examples of polarization curves measured repeatedly twice. The polarization curves of the amorphous alloys of the present invention after the surface activation treatment were all almost the same as those shown in FIG. 8 and were undistinguishable from each other. The first polarization curve measured after the surface activation treatment exhibited the anodic current density of the order of $10^0$ $Am^{-2}$ at about 0.4–0.8 V (SCE). This is due to dissolution of alloy constituents remaining without complete dissolution during the surface activation treatment in 46% HF. However, after the alloys were polarized at further higher potentials, the open circuit potential became very high and the second measurement of the polarization curve showed no longer active dissolution current in the potential region of 0.4–0.8 V (SCE). This indicates that, once the surface-activated alloys were polarized in the high potential region for chlorine evolution with a consequent dissolution of soluble constituents, the subsequent polarization does not result in alloy dissolution but evolves chlorine. The anodic current density for chlorine evolution at potentials higher than 1.0 V (SCE) are not different between the first and second measurements. For instance the current density at about 1.2 V (SCE) was increased about 4 orders of magnitude by the surface activation treatment.

In order to examine the corrosion resistance of the surface-activated alloys during chlorine evolution, the following procedures were made: Polarization in the 0.5 M NaCl solution of 30° C. at 1.25 V (SCE) for 12 hrs.; rinsing with distilled water and acetone; drying in a desiccator for 12 hrs.; weight measurements of the alloy specimens by a microbalance; polarization in the 0.5 M NaCl solution of 30° C. at 1.25 V (SCE) for 24 hrs.; rinsing with distilled water and acetone; drying in a desiccator for 12 hrs.; and weight measurements by the microbalance. By these procedures the measurements of the steady state weight losses of the alloy specimens during acting as the anode for the chlorine evolution for 24 hrs. were attempted. When these procedures were applied to specimens No. 70, 74, 78, 80, 82, 89 and 93 which are representative of the amorphous alloys of the present invention, no weight changes of the specimens used as the anode for electrolysis of the 0.5 M NaCl solution for 24 hrs. were detected. This reveals that they are immune to corrosion when used as the anode for chlorine evolution in the 0.5 M NaCl solution.

The current efficiencies of some alloys representative of the amorphous alloys of the present invention were measured by quantitative iodometric determination of chlorine evolved during electrolysis of the 0.5 M NaCl solution until 1000 coulomb/l. The current efficiencies are given in Table 10. The current efficiencies of the amorphous alloys of the present invention for chlorine evolution are similar to or higher than the current efficiency of the Pt-Ir/Ti electrode which is known to have the highest activity among currently used electrodes for the electrolysis of dilute NaCl solutions such as sea water.

The amorphous alloys of the present invention are all inexpensive because of low contents of platinum group metals.

TABLE 9

| Nominal Compositions of Alloys in Example 4 (at %) | | | | | | | | | | | |
|---|---|---|---|---|---|---|---|---|---|---|---|
| Specimen No. | Ni | Nb | Ta | Ti | Zr | Ru | Rh | Pd | Ir | Pt | P |
| 68 | 67 | | 30 | | | 1 | | | | | 2 |
| 69 | 66 | | 30 | | | 2 | | | | | 2 |
| 70 | 69.45 | | 30 | | | | 0.5 | | | | 0.05 |
| 71 | 68.5 | | 30 | | | | 1 | | | | 0.5 |
| 72 | 67.95 | | 30 | | | | 2 | | | | 0.05 |
| 73 | 66.5 | | 30 | | | | 3 | | | | 0.5 |
| 74 | 64.95 | | 30 | | | | 5 | | | | 0.05 |
| 75 | 64 | | 25 | | | | 10 | | | | 1 |
| 76 | 66.5 | | 30 | | | | 0.5 | 1 | | | 2 |
| 77 | 65.5 | | 30 | | | | 0.5 | 3 | | | 1 |
| 78 | 63.5 | | 30 | | | | 0.5 | 5 | | | 1 |
| 79 | 67 | | 30 | | | | | 1 | | | 2 |
| 80 | 55 | | 40 | | | | | 3 | | | 2 |
| 81 | 53 | | 40 | | | | | 5 | | | 2 |
| 82 | 66.5 | | 30 | | | | | 1 | 0.5 | | 2 |
| 83 | 64.5 | | 30 | | | | | 3 | 0.5 | | 2 |
| 84 | 38 | | 50 | | | | | 5 | | | 7 |
| 85 | 28 | | 60 | | | | | 9 | | | 2 |
| 86 | 69 | | 30 | | | | | | 0.5 | | 0.5 |
| 87 | 68.5 | | 30 | | | | | | 1 | | 0.5 |
| 88 | 67.5 | | 30 | | | | | | 2 | | 0.5 |
| 89 | 66.5 | | 30 | | | | | | 3 | | 0.5 |
| 90 | 68.95 | | 30 | | | | | | | 1 | 0.05 |
| 91 | 66.95 | | 30 | | | | | | | 3 | 0.05 |
| 92 | 59.93 | 20 | 20 | | | | | 0.02 | | | 0.05 |
| 93 | 59.9 | 15 | 25 | | | | | 0.05 | | | 0.05 |
| 94 | 48.5 | | 20 | 30 | | | | | 0.5 | | 1 |
| 95 | 57.5 | | 25 | | 15 | | | 0.5 | | | 2 |
| 96 | 58 | | 25 | 15 | | | | 0.5 | 0.5 | | 1 |
| 97 | 57.5 | | 25 | 15 | | | 0.5 | 1 | | | 1 |
| 98 | 31.9 | | 25 | | 40 | | | 3 | | | 0.1 |

TABLE 10

| Specimen No. | Current Efficiencies of Alloys for Chlorine Evolution in 0.5 M NaCl at 30° C. (%) Current Density A · m$^{-2}$ 500 | 1000 | 2000 | 3000 | 4000 | 5000 |
|---|---|---|---|---|---|---|
| 68 | | | 69.5 | | | |
| 70 | | | 62.7 | 62.7 | | |
| 72 | 56.3 | 66.2 | 71.4 | 66.9 | 66.9 | 66.0 |
| 74 | 58.5 | 66.9 | 71.8 | 66.9 | 66.3 | 63.3 |
| 76 | | | 87.3 | | | |
| 79 | | | 88.5 | | | |
| 81 | | | 88.3 | | | |
| 82 | 64.5 | 77.8 | 87.5 | 88.7 | 91.1 | 88.7 |
| 84 | | | 88.5 | | | |
| 86 | 74.2 | 73.0 | 83.8 | 83.8 | 85.6 | 85.0 |
| 87 | 68.4 | 76.2 | 84.3 | 84.1 | 85.6 | 85.0 |
| 88 | 62.7 | 71.5 | 82.6 | 85.0 | 85.2 | 85.2 |
| 89 | 70.6 | 76.6 | 82.6 | 85.6 | 85.6 | 84.4 |
| 90 | | | 95.9 | | | |
| 92 | | | 92.5 | | | |
| 95 | | | 93.3 | | | |
| 96 | | | 93.5 | | | |
| 98 | | | 92.3 | | | |
| Currently used Pt—IR/Ti Electrode for Comparison | 57.8 | 75.3 | 76.4 | | | |

EXAMPLE 5

Figure 9:
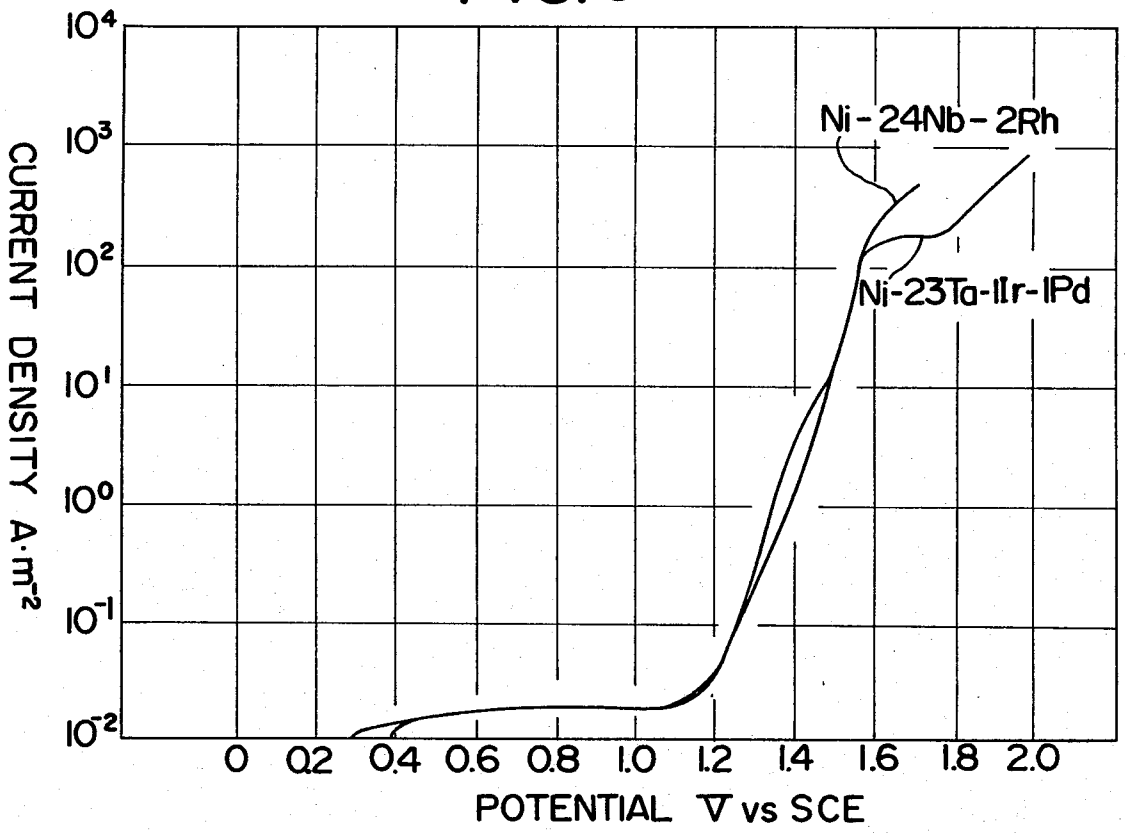
FIG. 9 shows anodic polarization curves of supersaturated solid solution Ni-24Nb-2Rh and Ni-23Ta-1Ir-1Pd alloys of the present invention measured in a 0.5 M NaCl solution at 30° C.

The supersaturated solid solution alloys were prepared similarly to Example 1. Their nominal compositions are given in Table 11. Surfaces of these alloys were polished mechanically with SiC paper up to #1000 in cyclohexane. The confirmation of high corrosion resistance of these alloys were carried out by measurements of anodic polarization curves in a 0.5 M NaCl solution at 30° C. FIG. 9 shows examples of polarization curves measured. Polarization curves of the supersaturated solid solution alloys are all quite similar to those shown in FIG. 9 and are not distinguishable from each other. These alloys are all spontaneously passive. Anodic polarization of these alloys leads to appearance of very low passive current densities less than $2\times10^{-2}$ Am$^{-2}$ up to about 1.1 V (SCE). A further increase in potential results in sharp current increase at about 1.2 V (SCE) due to evolutions of chlorine and oxygen.

Figure 10:
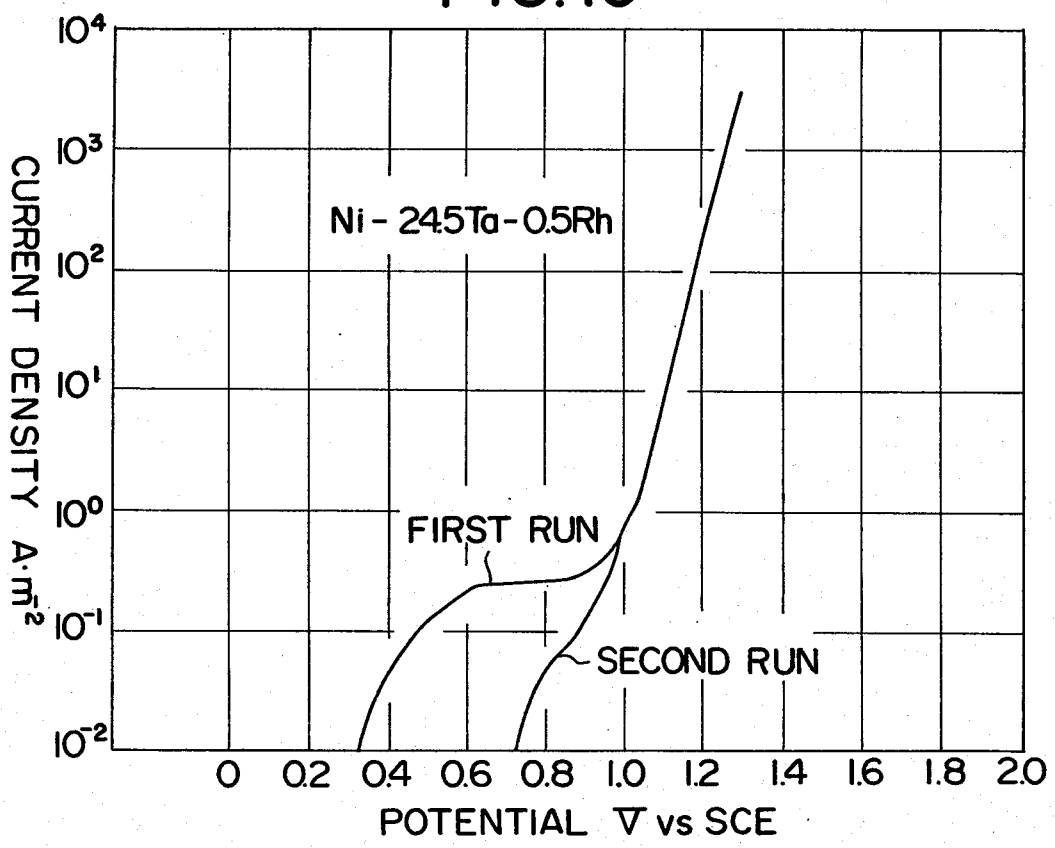
FIG. 10 shows anodic polarization curves of surface-activated supersaturated solid solution Ni-24.5Ta-0.5Rh alloy of the present invention measured repeatedly twice in a 0.5 M NaCl solution at 30° C.

The surface activation treatment of these alloys was carried out by immersion in 46% HF at ambient temperature for several minutes to several tens of minutes until the alloy surfaces turned black. Subsequently their anodic polarization curves were measured in the 0.5 M NaCl solution at 30° C. FIG. 10 shows examples of polarization curves measured repeatedly twice. The polarization curves of the supersaturated solid solution alloys of the present invention after the surface activation treatment were all almost the same as those shown in FIG. 10 and were undistinguishable from each other. The first polarization curve measured after the surface activation treatment exhibited the anodic current density of the order of $10^0$ Am$^{-2}$ at about 0.4–0.8 V (SCE). This is due to dissolution of alloy constituents remaining without complete dissolution during the surface activation treatment in 46% HF. However, after the alloys were polarized at further higher potentials, the open circuit potential became very high and the second measurement of the polarization curve showed no longer active dissolution current in the potential region of 0.4–0.8 V (SCE). This indicates that, once the surface-activated alloys were polarized in the high potential region for chlorine evolution with a consequent dissolution of soluble constituents, the subsequent polarization does not result in alloy dissolution but evolves chlorine. The anodic current density for chlorine evolution at potentials higher than 1.0 V (SCE) are not different between the first and second measurements. For instance the current density at about 1.2 V (SCE) was increased about 4 orders of magnitude by the surface activation treatment.

In order to examine the corrosion resistance of the surface-activated alloys during chlorine evolution, the following procedures were made: Polarization in the 0.5 M NaCl solution of 30° C. at 1.25 V (SCE) for 12 hrs.; rinsing with distilled water and acetone; drying in a desiccator for 12 hrs.; weight measurements of the alloy specimens by a microbalance; polarization in the 0.5 M NaCl solution of 30° C. at 1.25 V (SCE) for 24 hrs.; rinsing with distilled water and acetone; drying in a desiccator for 12 hrs.; and weight measurements by the microbalance. By these procedures the measurements of the steady state weight losses of the alloy specimens during acting as the anode for the chlorine evolution for 24 hrs. were attempted. When these procedures were applied to specimens No. 100, 102, 103, 109 and 117 which are representative of the amorphous alloys of the present invention, no weight changes of the specimens used as the anode for electrolysis of the 0.5 M NaCl solution for 24 hrs. were detected. This reveals that they are immune to corrosion when used as the anode for chlorine evolution in the 0.5 M NaCl solution.

The current efficiences of some alloys representative of the supersaturated solid solution alloys of the present invention were measured by quantitative iodometric determination of chlorine evolved during electrolysis of the 0.5 M NaCl solution until 1000 coulomb/l. The current efficiencies are given in Table 12. The current efficiencies of the supersaturated solid solution alloys of the present invention for chlorine evolution are similar to or higher than the current efficiency of the Pt-Ir/Ti electrode which is known to have the highest activity among currently used electrodes for the electrolysis of dilute NaCl solutions such as sea water.

The supersaturated solid solution alloys of the present invention are all inexpensive because of low contents of platinum group metals.

TABLE 11

| Specimen No. | Nominal Compositions of Alloys in Example 5 (at %) Ni | Nb | Ta | Ti | Zr | Ru | Rh | Pd | Ir | Pt | P |
|---|---|---|---|---|---|---|---|---|---|---|---|
| 99 | 72.5 | 24.5 | | | | 3 | | | | | |
| 100 | 74 | 24 | | | | | 2 | | | | |
| 101 | 70 | 20 | | | | | 10 | | | | |
| 102 | 76.92 | 23 | | | | | | 0.05 | | | 0.03 |
| 103 | 65.5 | 24.5 | | | | | | 3 | | | 7 |
| 104 | 69.5 | 24.5 | | | | | 5 | 1 | | | |
| 105 | 72 | 24.5 | | | | | | 1 | 0.5 | | 2 |
| 106 | 73.5 | 24.5 | | | | | | 1 | 1 | | |
| 107 | 74.5 | 24.5 | | | | | | | | 1 | |
| 108 | 75 | | 24.5 | | | | 0.5 | | | | |
| 109 | 73.5 | | 24.5 | | | | 2 | | | | |
| 110 | 72 | | 20 | | | | 7 | | | | 1 |
| 111 | 74 | | 24.5 | | | | | 0.5 | | | 1 |
| 112 | 74 | | 24.5 | | | | | 1 | 0.5 | | |
| 113 | 74.5 | | 24.5 | | | | | | | 1 | |
| 114 | 75 | | 23 | | | | | 1 | 1 | | |
| 115 | 72 | 20 | | 2 | 2 | | 3 | | | | 1 |
| 116 | 67.5 | 5 | | 15 | 4.5 | | 7 | | | | 1 |
| 117 | 66.5 | | 5 | 5 | 14.5 | | 8 | | | | 1 |
| 118 | 74 | | 20 | 1 | 3 | | | 1 | 1 | | |
| 119 | 74.5 | 5 | 10 | 5 | 3 | | 0.5 | 1 | | | 1 |

TABLE 12

| Current Efficiencies of Alloys for Chlorine Evolution in 0.5 M NaCl at 30° C. | |
|---|---|
| Specimen No. | Current Efficiency at 2000 $Am^{-2}$ (%) |
| 99 | 68.1 |
| 100 | 67.5 |
| 103 | 91.5 |
| 105 | 92.3 |
| 107 | 94.0 |
| 109 | 68.3 |
| 111 | 92.9 |
| 114 | 93.1 |
| 118 | 91.5 |
| 119 | 92.0 |
| Current used Pt—Ir/Ti Electrode for Comparison | 76.4 |

What is claimed is:

1. Surfaces activated amorphous alloys suitable for chlorine evolution electrode for electrolysis of chloride-containing aqueous solutions which comprise 25 to 65 at % Nb, and at least one element of 0.01 to 10 at % selected from the group consisting of Ru, Th, Pd, Ir and Pt, with the balance bieng substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

2. Surface activated amorphous alloys suitable for chlorine evolution electrodes for electrolysis of chloride-containing aqueaous solutions which comprise 25 to 65 at % in the total of 10 at % or more Nb and at least one element selected from the group consisting of Ti, Zr and less than 20 at % Ta, and at least one element of 0.01 to 10 at % selected from the group consisting of Ru, Rh, Pd, Ir and Pt, with the balance being substantially Ni, the surface activation of said alloy being effected by immersion of said alloy in a solution selected from hydrofluoric acid fluoride-containing solutions to selectively dissolve Ni, Nb, Ta, Ti and Zr resulting in surface roughening and in enrichment of electrocatalytically active platinum group elements in the surface region of said alloy.

3. Surface activated amorphous alloys suitable for chlorine evolution electrodes for electrolysis of chloride containing aqueous solutions which comprise 25 to 65 at % Nb, at least one element of 0.01 to 10 at % selected from the group consisting of Ru, Rh, Pd, Ir and Pt, and less than 7 at % P, with the balance being substantially 20 at % or more Ni and then the above atomic percentages are based on the total composition of the alloy, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

4. Surface activated amorphous alloys suitable for chlorine evolution electrodes for electrolysis of chloride-containing aqueous solutions which comprise 25 to 65 at % in the total of 10 at % or more Nb and at least one element selected from the group consisting of Ti, Zr, and less than 20 at % Ta, at least one element of 0.01 to 10 at % selected from the group consisting of Ru, Rh, Pd, Ir and Pr, and less than 7 at % P, with the balance being substantially 20 at % or more Ni, and then the above atomic percentages are based on the total composition of the alloy, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

5. Surface activated amorphous alloys suitable for chlorine evolution electrodes for electrolysis of chloride-containing aqueous solutions which comprise 25 to 65 at % in the total of 5 to less than 20 at % Ta and at least one element selected from the group consisting of Ti, Zr and less than 10 at % Nb, and at least one element of 0.01 to 10 at % selected from the group consisting of Ru, Rh, Pd, Ir and Pt, with the balance being substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

6. Surface activated amorphous alloys suitable for chlorine evolution electrodes for electrolysis if chloride containing aqueous solutions which comprise 25 to 65 at % in the total of 5 to less than 20 at % Ta and at least one element selected from the group consisting of Ti, Zr and less than 10 at % Nb, at least one element of 0.01 to 10 at % selected from the group consisting of Ru, Rh, Pd, Ir and Pt, and less than 7 at % P, with the balance being substantially 20 at % or more Ni and then the above atomic percentages are based on the total composition of the alloy, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

7. Surface activated amorphous alloys suitable for chlorine evolution electrodes for electrolysis of chloride containing aqueous solutions which comprise 25 to 65 at % Ta, at least one element of 0.01 to 10 at % selected from the group consisting of Ru, Rh, Pd, Ir and Pt, and less than 7 at % P, with the balance being substantially 20 at % or more Ni, and then the above atomic percentages are based on the total composition of the alloys, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

8. Surface activated amorphous alloys suitable for chlorine evolution electrodes for electrolysis of chloride containing aqueous solutions which comprise 25 to 65 at % in the total of 20 at % or more Ta and at least one element selected from the group consisting of Ti, Zr and Nb, at least one element of 0.01 to 10 at % selected from the group consisting of Ru, Rh, Pd, Ir and Pt, and less than 7 at % P, with the balance being substantially 20 at % or more Ni, and then the above atomic percentages are based on the total composition of the alloys, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

9. Surface activated supersaturated solid solution alloys suitable for chlorine evolution electrodes for electrolysis of chloride-containing aqueous solutions which comprise 20 to less than 25 at % either or both Nb and Ta, and at least one element of 0.01 to 10 at % selected from the group consisting of Ru, Rh, Pd, Ir and Pt, with the balance being substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

10. Surface activated supersaturated solid solution alloys suitable for chlorine evolution electrodes for electrolysis of chloride-containing aqueous solutions which comprise 20 to less than 25 at % either or both Nb and Ta, and at least one element of 0.01 to 10 at % selected from the group consisting of Ru, Rh, Pd, Ir and Pt, and less than 7 at % p, with the balance being substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

11. Surface activated supersaturated solution solution alloys suitable for chlorine evolution electrodes for electrolysis of chloride-containing aqueous solutions which comprise 20 to less than 25 at % in the total of either or both Ti and Zr and 5 at % or more of either of both Nb and Ta, and at least one element of 0.01 to 10 at % selected from the group consisting of Ru, Rh, Pd, Ir and Pt, with the balance being substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

12. Surface activated supersaturated solid solution alloys suitable for chlorine evolution electrodes for electrolysis of chloride-containing aqueous solutions which comprise 20 to less than 25 at % in the total of either or both Ti and Zr and 5 at % or more of either or both Nb and Ta, at least one element of 0.01 to 10 at % selected from the group consisting of Ru, Rh, Pd, Ir and Pt, and less than 7 at % P, with the reference being substantially Ni, the surface activation of said alloy being effected by immersion of said alloy in a solution selected from hydrofluoric acid or fluoride-containing solutions to selectively dissolve Ni, Nb, Ta, Ti and Zr resulting in surface roughening and in enrichment of electrocatalytically active platinum group elements in the surface region of said alloy.

* * * * *